US006396382B1

(12) United States Patent
Ross

(10) Patent No.: US 6,396,382 B1
(45) Date of Patent: May 28, 2002

(54) THERMALLY ACTUATED CONTROL DEVICE

(75) Inventor: Steven J. Ross, Evanston, IL (US)

(73) Assignee: Levingard Technologies, Inc., Arroyo Grande, CA (US)

( * ) Notice: Subject to any disclaimer, the term of this patent is extended or adjusted under 35 U.S.C. 154(b) by 0 days.

(21) Appl. No.: 09/393,145

(22) Filed: Sep. 10, 1999

(51) Int. Cl.[7] ..... H01H 37/48; H01H 37/46

(52) U.S. Cl. ..... 337/393; 337/394; 337/395; 60/527; 60/516

(58) Field of Search ..... 337/393, 12, 140, 337/339, 141, 343, 298, 14, 394, 395; 148/402, 563; 60/527, 528, 516, 523

(56) References Cited

U.S. PATENT DOCUMENTS

| | | | | |
|---|---|---|---|---|
| 3,588,618 A | | 6/1971 | Otte | 317/101 |
| 3,634,803 A | * | 1/1972 | Willson et al. | 337/123 |
| 3,748,197 A | * | 7/1973 | Willson et al. | 148/131 |
| 3,846,679 A | * | 11/1974 | Jost et al. | 317/132 |
| 3,952,274 A | | 4/1976 | Plasko | 337/407 |
| 3,956,725 A | | 5/1976 | Merrill et al. | 337/407 |
| 3,967,227 A | * | 6/1976 | Clarke et al. | 337/124 |
| 4,075,596 A | | 2/1978 | Plaske | 337/408 |
| 4,246,564 A | | 1/1981 | Olson et al. | 331/409 |
| 4,281,309 A | | 7/1981 | Olson | 337/409 |
| 4,309,685 A | | 1/1982 | Candor | 337/408 |
| 4,314,224 A | | 2/1982 | Plasko | 337/408 |
| 4,342,980 A | | 8/1982 | Kovacs | 337/407 |
| 4,342,981 A | | 8/1982 | Yagher, Jr. | 337/407 |
| 4,342,982 A | | 8/1982 | Plasko | 337/407 |
| 4,411,061 A | | 10/1983 | Clapper et al. | 29/622 |
| 4,423,401 A | | 12/1983 | Mueller | 337/107 |
| 4,533,897 A | | 8/1985 | Olson et al. | 337/408 |
| 4,544,988 A | * | 10/1985 | Hochstein | 361/211 |
| 4,787,854 A | | 11/1988 | Le Parquier | 439/67 |
| 4,806,815 A | * | 2/1989 | Honma | 310/307 |
| 4,885,560 A | * | 12/1989 | Niino | 337/3 |
| 5,235,308 A | * | 8/1993 | Shimada et al. | 337/377 |
| 5,410,290 A | * | 4/1995 | Cho | 337/140 |
| 5,463,233 A | | 10/1995 | Norling | 257/254 |
| 5,467,068 A | | 11/1995 | Field et al. | 335/4 |
| 5,510,598 A | | 4/1996 | Kawam et al. | 219/505 |
| 5,973,587 A | * | 10/1999 | Hofsass | 337/377 |
| 5,977,858 A | * | 11/1999 | Morgen et al. | 337/140 |
| 5,990,777 A | * | 11/1999 | Whiteman, Jr. | 337/140 |
| 6,049,267 A | * | 4/2000 | Barnes et al. | 337/123 |

FOREIGN PATENT DOCUMENTS

| | | |
|---|---|---|
| FR | 2766962 | 7/1999 |
| GB | 1584914 | 2/1978 |

OTHER PUBLICATIONS

Academic Press Dictionary of Science and Technology, Edited by Christopher Morris, Academic Press, Inc., 1992, p. 903.*

Morand Jean Luc, *Integrated circuit–compatible mechanical–type thermal micro–switch*, Feb. 5, 1999, 1 page.

* cited by examiner

*Primary Examiner*—Leo P. Picard
*Assistant Examiner*—Anatoly Vortman
(74) *Attorney, Agent, or Firm*—Koppel, Jacobs, Patrick & Heybl; Michael J. Ram

(57) ABSTRACT

A micro miniature solid state mechanical switch device operated by thermal energy for the control of thermal and electrical energy is shown. A gap in an energy path is bridged by an energy conductor that is mechanically moved into and out of operative position with the gap in the energy path.

16 Claims, 3 Drawing Sheets

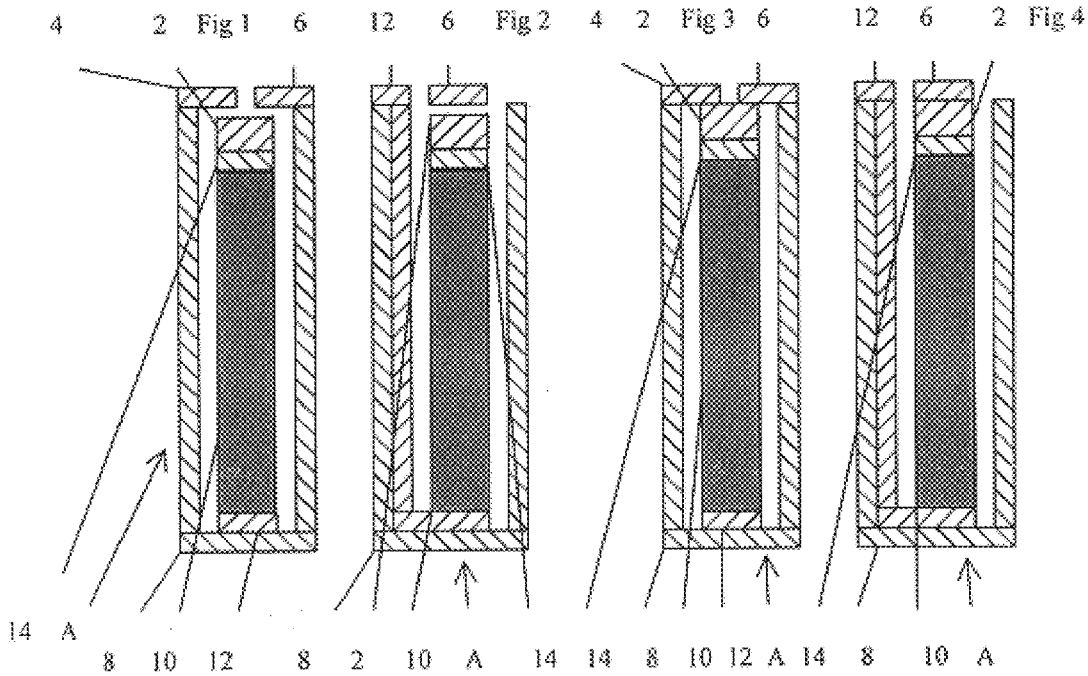
4 2 Fig 1 6
12 6 Fig 2
4 2 Fig 3 6
12 6 2 Fig 4
14 A
8 10 12
8 2 10 A
14 14 8 10 12 A
14 8 10 A
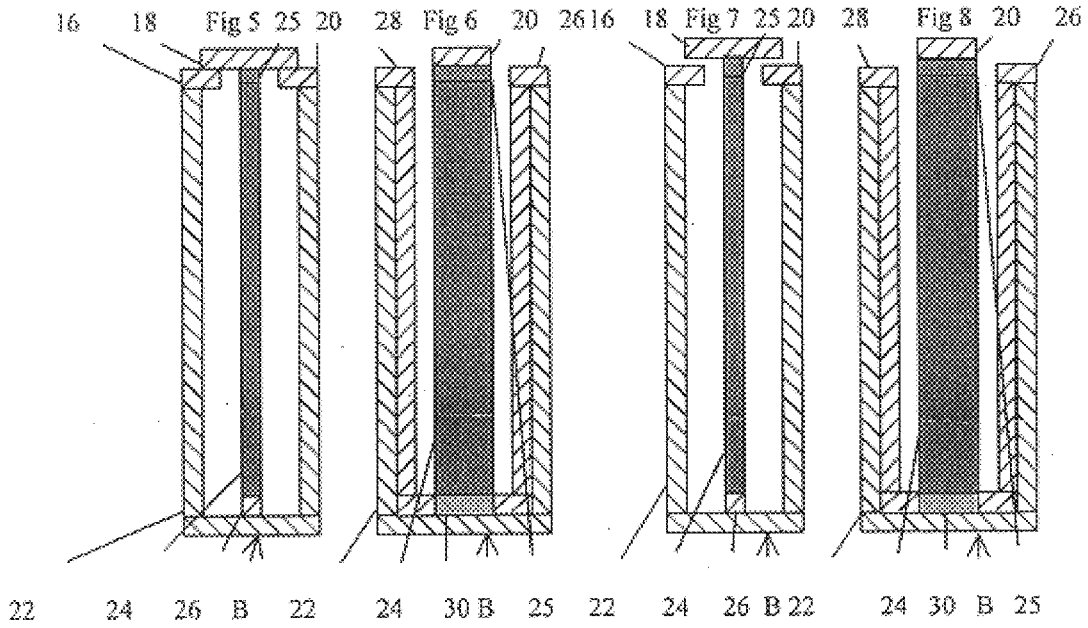
16 18 Fig 5 25 20
28 Fig 6 20 26
16 18 Fig 7 25 20
28 Fig 8 20 26
22 24 26 B
22 24 30 B 25
22 24 26 B
22 24 30 B 25

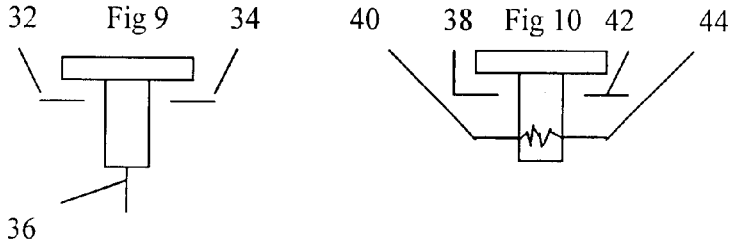
Fig 11
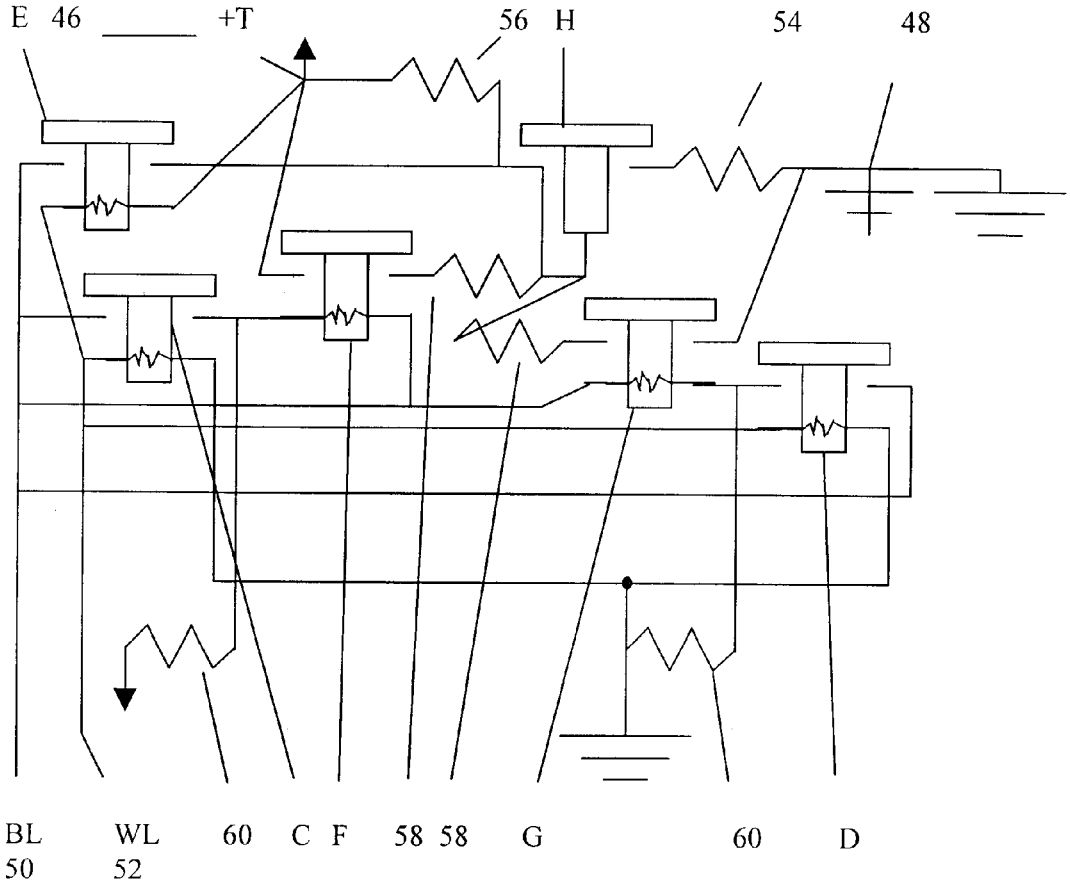

4'
2'

6'
14'
8'
10'
12'

4''
2''

6''
8''
10''
12''

THERMALLY ACTUATED CONTROL DEVICE

BACKGROUND OF INVENTION

This invention relates to solid state devices for controlling the flow of energy and more particularly to control devices, operated by application of thermal energy, which physically move energy transmission elements in and out of an energy flow path to selectively control the flow of energy along said path.

For the last several decades devices for controlling the flow of energy and operation of machines have typically consisted of electronic devices such as the transistor and related solid state components which have resulted in a multitude of high speed, small size and low power drain devices previously unknown. Mechanical devices could no longer compete because of their inherent large size, slow speed, and high operating energy requirements.

OBJECTS AND SUMMARY OF INVENTION

Accordingly it is an object of the present invention to provide a mechanically operated solid state device that overcomes the limitations of the prior art.

It is another object of the present invention to provide a mechanically operated energy control device that closely approaches the size, speed, and power drain of electronic devices.

It is a further object of the present invention to provide a thermal energy operated micro-miniature device capable of controlling the flow of energy in a circuit with a size and speed approaching that of semi-conductor devices such as the transistor.

It is a still further object of the present invention to provide a thermal energy operated micro-miniature mechanical switch device that is radiation survivable, electronic pulse resistant, and heat resistant as compared to semiconductor devices.

It is yet another object of the present invention to provide a thermal energy operated micro-miniature mechanical switch device which is totally solid state and can be manufactured by current semiconductor technology.

It is yet another object of the present invention to provide a thermal energy operated micro-miniature mechanical switch device that is competitive with electronic devices in cost, speed, size, and power requirements.

In an embodiment of the present invention a gap in an energy path of one micron is bridged by a gate spaced 1.5 nm away which is moved into contact across said gap by the expansion of a thermal expander in contact with said gate in less than 700 ns with a switching temperature change of 11.5K.

BRIEF DESCRIPTION OF DRAWINGS

FIG. 1 is a diagramatic view of a thermal device according to the present invention taken on the x-z plane with the device in the "off" position;

FIG. 2 is a similar view taken on the y-z plane of the device of FIG. 1;

FIG. 3 is a view similar to FIG. 1 but with the device in the "on" position;

FIG. 4 is a view similar to FIG. 2 but with the device in the "on" position;

FIG. 5 is a view similar to FIG. 1 of an electrical device according to the present invention in the "on" position;

FIG. 6 is a view taken on the y-z plane of the device of FIG. 5;

FIG. 7 is a view similar to FIG. 5 with the device in the "off" position;

FIG. 8 is a view similar to FIG. 6 with the device in the "off" position;

FIG. 9 is a schematic view of a thermal switch that is the inverse of the switch shown in FIGS. 1–4;

FIG. 10 is a schematic view of an electrical switch as shown in FIGS. 1–4;

FIG. 11 is a schematic view of a pulse resistant memory cell using the devices of the present invention;

PREFERRED EMBODIMENT

Figure 12:
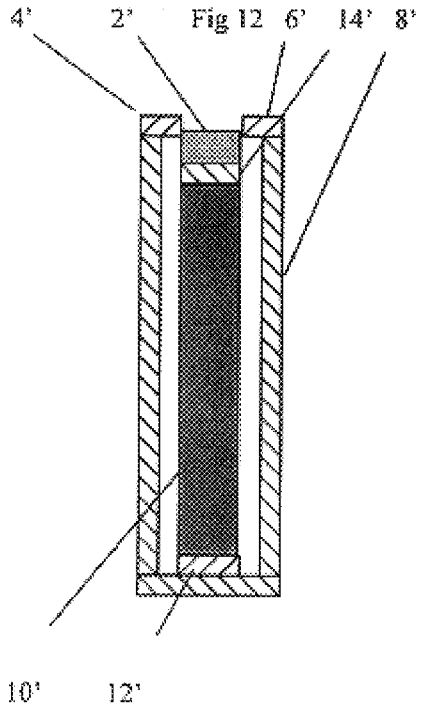
FIG. 12 is a view similar to FIG. 1 showing another embodiment of the present invention.

Referring now to FIG. 1 an energy controller (device A) is shown with a body portion 8 made of a thermal insulating material. At the upper end a pair of conductor members 4 & 6 are mounted on the insulator body 8. Mounted within thermal insulating body 8 is thermal expander/contracter member 10. Mounted on top of expander member 10 is bridging member 2. Bridging member 2 is separated from direct contact with expander/contractor 10 by insulator 14 which may also serve as a shock absorber. Bridge insulator 14 stops current from flowing from the input and output to the expander/contracter 10. Thermal connection to expander/contracter 10 is made by thermal conductor 12 which brings the thermal energy to and from the expander/contracter 10.

The term "expander/contracter" is used to denote the element that physically moves a bridging member into and out of operative relationship with an energy transmission path. The term "bridging member" is used to denote the third conductor element that in some embodiments bridges the gap between the two transmission path conductors. In other embodiments as described herein the bridging member may be interposed in a gap between the first two conductors either in or out of physical contact therewith. The "energy control devices A & B" shown in FIGS. 1–8 are customarily referred to as a "switch" since energy is either "on" or "off". In other embodiments, as will be described herein, devices A & B may function as a "modulator" of the flow of energy.

In one embodiment device A, FIG. 1, is 10 um high, and 1.5 um across, with a gap of one micron. The gap spacing between the bridge 2 and conductors 4 & 6 is 1.5 nm+/−1 nm. The conductors are of high thermal diffusivity thin film diamond, the expander is aluminum, and the insulator an elastic polymer such as silicone. The expander 10 is configured so as to have an expansion distance of 3 nm to ensure closing of the gap by movement of the bridge 2 into contact with the conductors 4 & 6. With the foregoing no high purity materials are needed and fabrication can be accomplished with low quality CVD and lithography. For these reasons among others the device is relatively cheap to manufacture compared to traditional semiconductor devices.

In some applications resistive heating with electrical energy may be used to activate expander 10. FIGS. 5–8 show, in inverse form, such an embodiment in which body 22 may be a thermally conductive substrate, on which are mounted input conductor 16 and output conductor 20. Bridging conductor 18 is mounted on bridge insulator 25 fixed on the upper end of expander/contracter 24. Insulator 25 may also function as a shock absorber. Bridge resistor 30 is mounted on the lower end of expander 24 and heats expander 24 when current is passed therethrough. Electrical power conductor 28 is connected to one side of resistor 30 and the other side is connected to ground conductor 26. FIGS. 5 & 6 show the switch B with contacts closed in the power off mode while FIGS. 7 & 8 show the circuit broken when power is applied to resistor 30 to heat expander 24.

The embodiment of FIGS. 1–4 is optimized for use of thermal energy which frequently is waste energy in various electronic devices. The use of thermal energy for the moving of the bridge 2 results in a device that is highly resistant to radiation, and electronic pulses that sometimes affect conventional semiconductor devices.

In addition to thermal operating energy shown in FIGS. 1–4 and electrical operating energy to produce the thermal energy, as shown in FIGS. 5–8, optical energy could be used to heat the expander 10 by focusing a small amount of photons on the expander/contracter 10 to cause the necessary mechanical movement.

The embodiments shown in FIGS. 1–8 have been described as controlling thermal energy. In an embodiment in which the controlled output energy is electrical rather than thermal the conductors 4,6,6,16, & 20 are made of aluminum or some other metal rather than thin film diamond as described above. Also bridges 2 & 18 would be made of the same material as the conductors. Operation of the device would be the same except the energy being controlled would be electrical.

As shown in FIG. 12 the bridge 2' is configured to just slide between conductors 4' & 6' in intimate contact therewith. In this configuration bridge 2' would be made from a resistive material instead of a pure conductive material. The amount of thermal or electrical energy allowed to flow through conductors 4' & 6' would thus be dependent on the percentage of cross sectional area in contact in the flow path and the resistance of the bridge material. Thus in addition to functioning as a switch the device can act as a modulator for various applications.

Figure 13:
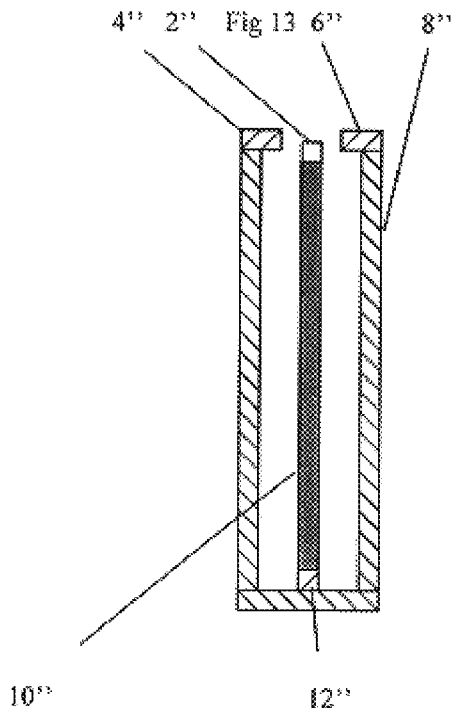
FIG. 13 is a view similar to FIG. 1 showing a still further embodiment of the present invention.

Referring now to FIG. 13 there is shown an embodiment for controlling optical energy. In one form the bridge 2" has a layer of opaque material and a layer of optical conductor material. The expander 10" now moves the bridge so as to block or allow light flow across the gap. Alternatively the bridge 2" has a reflective mirror surface configured to direct the light energy across the gap from one optical conductor to the other or to direct it out of the gap and thus block flow of the light energy. Again by controlling the proportion of energy passed a modulation effect can be obtained.

Referring now to FIG. 9 I have shown an inverse thermal switch in schematic form. The energy to be controlled input lead is shown at 32, the output lead at 34, and the bridge control lead at 36. In contrast FIG. 10 shows schematically an inverse electrical switch. The electrical energy to be controlled input and output leads are shown at 38 and 42. The electrical energy for the bridge resistor is supplied through lead 40 and lead 44 is typically grounded.

Referring now to FIG. 11 I have shown a pulse resistant memory cell utilizing the switches of the present invention. Electrically operated switches C–G are used to operate thermal switch H as follows. A temperature source T shown at 46 is connected through power resistor 56 which functions as both a thermal and electrical resistor, to the bridge control lead and energy input conductor of thermal switch H as well as through resistors 58 to the output conductor of switch E and the input conductor of switch G. The output conductor of thermal switch H is connected through resistor 54 to both thermal and electrical grounds and switch G's output conductor. Temperature source 46 is also connected to the output lead of switch E through resistor 56 and directly to the input conductor of switch F.

Bit line 50 is connected to the input conductors of switches C & E; the output conductor of switch D; and to one side of the bridge resistor for switches F & G. The other side of switch G bridge resistor is connected to the input conductor of switch D and through resistor 60 to ground. The other side of switch F bridge resistor is connected to a power source represented by an arrow head through resistor 60. Write line 52 is connected to one side of the bridge resistors for switches C,D, &E. The other side of the bridge resistor for switch E is connected to a power source indicated by an arrow head.

In operation if there is no input from write line 52 switches C & D let current through the input and output conductors via their respective bridges. When line 52 turns on switches C & D switch off. Switches F & G are powered by the bit line 50. When switches C & D are "on", the power and ground bridge conductors for switches F & G are both connected the bit line so no voltage is applied to switches F & G. When C & D are off from a line 52 input, power leaks through resistors 60 and the switch F or G, with a difference between its power and ground, switches on. If the bit line 50 is positive, the switch G switches off letting switch F dominate with its hot signal. If the bit line 50 is ground the reverse takes place. The actual memory switch is thermal switch H. Switch F when on brings in a heat input along with a small heat component through thermal resistor 56 when switch H is off. If switch H is on a larger cold component is added through switch G. This makes the device control itself, when it is heated up it switches off, and keeps itself off until another signal comes. If it is on, it keeps itself on with a cold signal.

Switch E controls reading from the memory component. When the write line 52 is off, the device is heated into its "off" position by the difference in voltages. When the write line 52 turns "on", switch E cools down and switches into the "on" position, reading the memory onto the bit line. If a writing operation is occurring then the bit line will be set too strongly to change. If it isn't, then the signal is read out.

If an electrical pulse hits this device, it will heat up the electrical switches, switching them off, and letting the thermal device control itself. As long as one doesn't switch a long time before the other, the heat of the thermal switch won't change enough to switch it, and it will hold it's original data, waiting for a reset to read its stored data back.

While in the foregoing embodiments I have shown the expanders 10 & 24 actually increasing in one dimension (longitudinally), it will be obvious to those skilled in the art that the expander could actually contract to effectuate opening or closing of the gap. The gap Could be closed as in FIGS. 3 & 4 and the expander member expansion/contraction used to break the circuit rather than close it. Also cooling of the expander member could be used instead of heating without departing from the concept of using thermal energy to physically move an element to control flow of energy. In all of the embodiments it is the physical movement (extending or contracting longitudinally) of an element caused by application/withdrawal of thermal energy that produces the desired effect.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

I claim:

1. A device for controlling energy flow along an energy transmission path which comprises:

a micro-miniature solid state energy controller having first and second energy conducting members spaced apart a distance sufficient to impede energy transmission from one to the other and form a gap in the micron size range therebetween;

a third energy conducting member sized to selectively bridge said gap between said first and second energy conducting members; and an expander/contractor member operatively engaging said third energy conducting member; and said expander/contractor member consisting of a material that expands or contracts in length upon change of energy applied thereto and configured to longitudinally move said third energy conducting member into and out of energy flow controlling position bridging said gap between said first and second energy conducting members;

whereby energy flow through said first and second energy conducting members may be selectively controlled.

2. A micro-miniature solid state energy control device according to claim 1 wherein said third energy conductive member is spaced apart from said first and second energy conducting members adjacent said gap; and said expander/contracter member selectively moves said third member into bridging contact with said first and second conducting members.

3. A solid state energy control device as claimed in claim 2 wherein said energy conducting members are chosen to transmit thermal energy; and said expander/contracter member expands upon application of thermal energy.

4. A solid state energy control device as claimed in claim 2 wherein said energy conducting members are chosen to transmit electrical energy; and said expander/contracter member expands upon application of thermal energy.

5. A solid state energy control device as claimed in claim 2 wherein said energy conducting members are chosen to transmit light energy; and said expander/contracter member expands upon application of thermal energy.

6. A solid state energy control device as claimed in claim 5 wherein said third energy conducting member is a mirror; and said expander/contracter member moves said mirror to direct light energy onto and away from said first and second conducting members.

7. A solid state energy control device as claimed in claim 2 wherein said said third conducting member is spaced from said gap in said first and second conducting members a distance of 1.5 nm+/−1 nm; and said expander/contracter member expands a distance of 3 nm maximum.

8. A solid state energy control device as claimed in claim 1 wherein said third energy conducting member is sized to fit within said gap to selectively complete said transmission path from said first to said second conducting members; and said expander/contracter member moves said third energy conducting member into and out of said gap to modulate the energy transmitted along said transmission path.

9. A micro-miniature solid state energy control device according to claim 1 wherein said third energy conductive member bridges said first and second energy conducting members across said gap; and said expander/contracter member selectively moves said third member out of bridging contact with said first and second conducting members.

10. A micro miniature solid state energy control device according to claim 9 wherein said expander/contracter member consists of a material that contracts upon reduction of thermal energy to withdraw said third energy conductive member out of bridging contact with said pair of energy conductive members.

11. A device for controlling energy flow along an energy transmission path which comprises:

a micro-miniature solid state energy controller having first and second energy conducting members spaced apart a distance sufficient to impede energy transmission from one to the other and form a gap therebetween;

a third energy conducting member sized to selectively bridge said gap between said first and second energy conducting members;

an expander/contractor member operatively engaging said third energy conducting member, the expander/contractor member expanding or contracting in length up to about 3 nm upon change of energy applied thereto to effect bridging between the first and second energy conducting members; and said expander/contracter member consisting of a material that expands or contracts in length upon change of energy applied thereto and configured to longitudinally move said third energy conducting member into and out of energy flow controlling position bridging said gap between said first and second energy conducting members;

whereby energy flow ignore through said first and second energy conducting members may be selectively controlled.

12. A method of controlling a flow of energy along a conductive path which comprises the steps of:

forming a physical gap in an energy conducting path so as to impede energy flow there along;

forming a bridging member configured to selectively modify energy flow across said gap;

positioning said bridging member adjacent said gap;

positioning an expander/contractor member in operative contact with said bridging member so as to move said bridging member into and out of energy flow modifying association with said gap upon expansion/contraction thereof wherein the expander/contractor member expands in length up to about 3nm upon application of thermal energy thereto to effect bridging contact between the pair of energy conducting members; and selectively applying energy to said expander/contractor member to cause sufficient longitudinal expansion/contraction thereof to move said bridging member into and out of energy flow modifying association with said gap;

whereby the flow of energy along said path may be controlled by the selective application of energy only to said expander/contractor member.

13. The method of claim 12 further including applying thermal energy only to said expander/contractor member.

14. The method of claim 12 further including applying energy only to said expander/contractor member.

15. The method of claim 12 wherein said flow of energy consists of thermal energy and said energy selectively applied to said expander/contractor member is thermal energy.

16. A micro-miniature mechanical switch for making or breaking an energy transmission path which comprises:

a pair of energy conductive members spaced apart a distance sufficient to block energy transmission from one conductor member to the other conductor member and form a gap therebetween;

a third energy conductive member sized to bridge said gap between said pair of energy conductive members;

said third energy conductive member being spaced apart from said pair of energy conductive members adjacent said gap;

an expander member operatively engaging said third energy conductive member said expander member consisting of a material expanded longitudinally by application of thermal energy and configured to move said third energy conductive member into bridging contact with said pair of energy conductive members across said gap wherein the expander member expands in length up to about 3nm upon change of energy applied thereto to move said member into energy flow association with said gap;

whereby energy may selectively flow through said pair of energy conductive members.

* * * * *